US005119699A

United States Patent [19]

McBride et al.

[11] Patent Number: 5,119,699

[45] Date of Patent: Jun. 9, 1992

[54] SAFETY HAMMER ASSEMBLY

[76] Inventors: Earl S. McBride, P.O. Box 204, Janesville, Calif. 96114; Bill E. Bayer, 724 Main St. P.O. Box 233, Susanville, Calif. 96130

[21] Appl. No.: 675,867

[22] Filed: Mar. 27, 1991

[51] Int. Cl.[5] ..... B25D 1/02

[52] U.S. Cl. ..... 81/25; 81/23

[58] Field of Search ..... 81/20, 23, 25

[56] References Cited

U.S. PATENT DOCUMENTS 1,262,515 4/1918 Kingsley ..... 81/20

4,291,736 9/1981 Robertson et al. ..... 81/25 X 5,062,324 11/1991 Saviano ..... 87/20

*Primary Examiner*—James G. Smith

*Attorney, Agent, or Firm*—Leon Gilden

[57] ABSTRACT

A hammer including an elongate hammer head mounted orthogonally to a handle. The hammer head includes an impact head, wherein the impact head is defined by an impact face that defines an acute angle relative to the elongate handle axis of substantially 8 to 11.5 degrees to minimize strain and deflection upon an individual impacting a nail in use of the hammer. The impact face includes a semi-spherical recess to receive the nail and minimize deflection of various portions of the nail that may be fractured upon impact. A modification of the invention includes deformable inserts mounted within the semi-spherical recess for minimizing abrasion to various upholstery nails and the like upon impact.

2 Claims, 4 Drawing Sheets

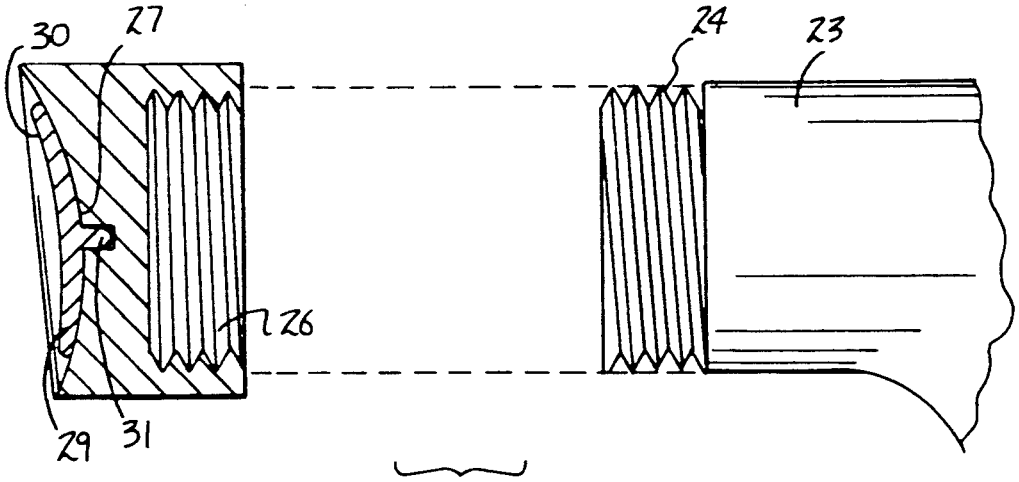
Fig 5
Fig 6
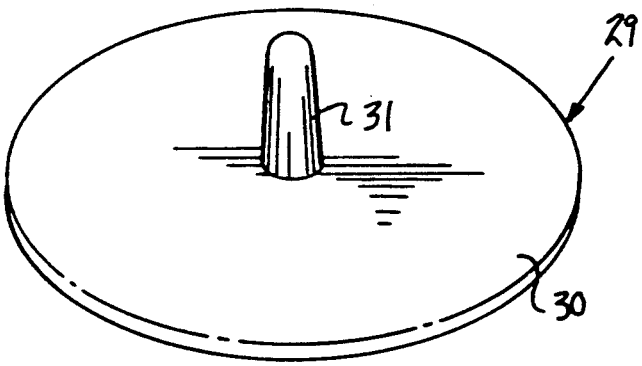

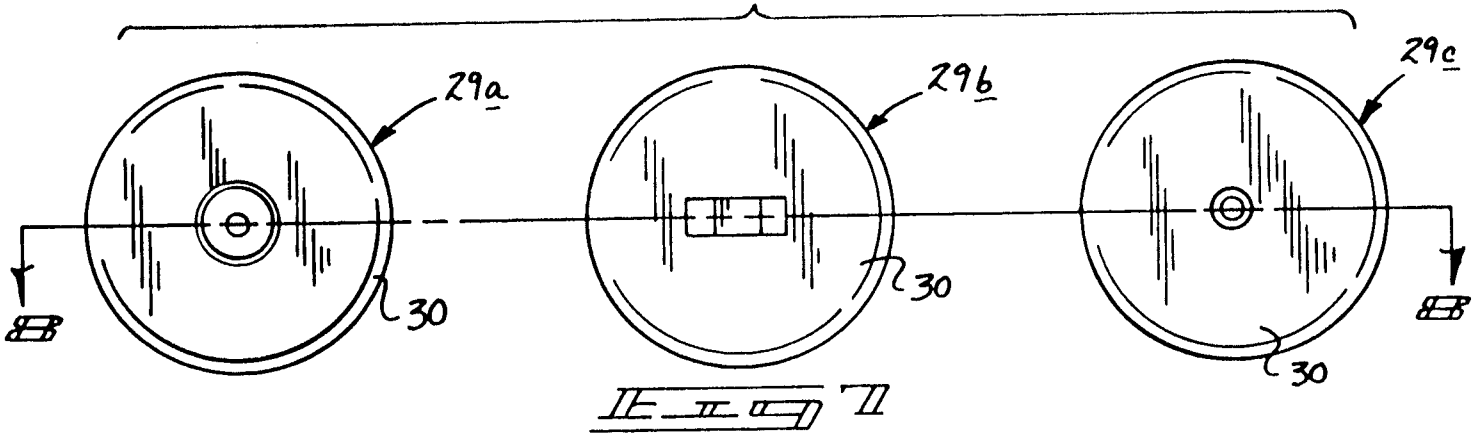
FIG. 11
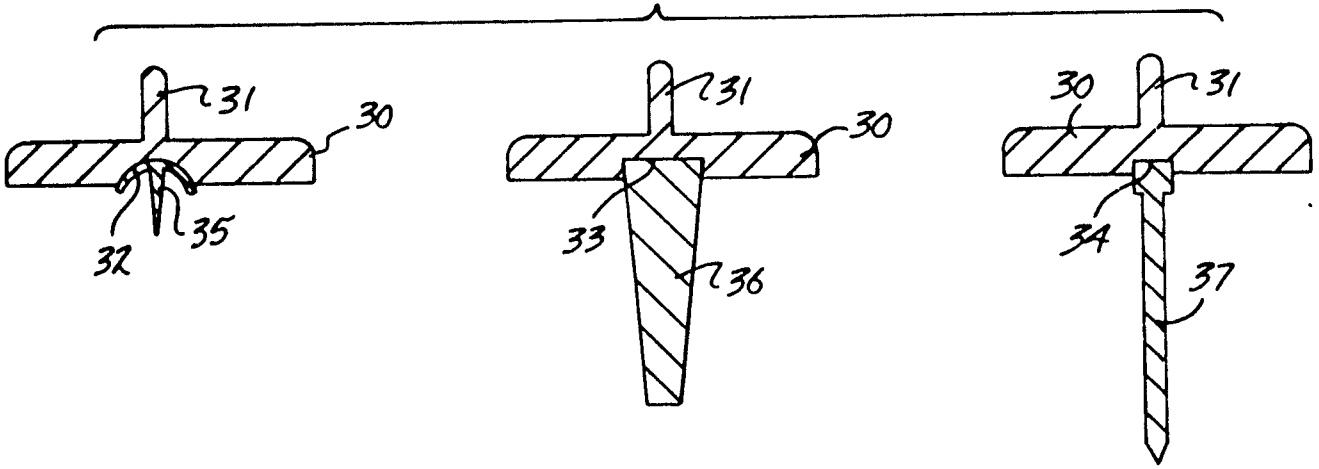

SAFETY HAMMER ASSEMBLY

BACKGROUND OF THE INVENTION

1. Field of the Invention

The field of invention relates to hammer apparatus, and more particularly pertains to a new and improved safety hammer assembly wherein the same is arranged to provide minimum shock to an individual's arm during use of the hammer assembly.

2. Description of the Prior Art

Various hammer organizations have been utilized in the prior art for accommodating various operative situations in use of the hammer. Such prior art is exemplified in U.S. Pat. No. 3,796,244 to Florian wherein a hammer member utilizes a double-headed impact surface, wherein the impact surfaces are angulated relative to one another at a substantial twenty degree offset.

U.S. Pat. No. 3,786,847 to Schera, Jr. sets forth a safety sledge hammer that is formed with a conical receiving surface to accommodate impact of various rods and the like struck by the sledge hammer, as opposed to the instant invention wherein the semi-spherical recess guides and directs the impacting nail medially of the impact face, as well as shrouding the nail member containing fragments that may be separated from the nail member during impact.

As such, it may be appreciated that there continues to be a need for a new and improved safety hammer assembly as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of safety hammer apparatus now present in the prior art, the present invention provides a safety hammer assembly wherein the same utilizes a semi-spherical recess formed within an impact face, with the impact face oriented at an acute angle between 8 and 11.5 degrees relative to an axis defined by the elongate handle to minimize shock to an operator of the hammer. As such, the general purpose of the present invention, which will be described subsequently in greater detail, is to provide a new and improved safety handle assembly which has all the advantages of the prior art safety hammer apparatus and none of the disadvantages.

To attain this, the present invention provides a hammer including an elongate hammer head mounted orthogonally to a handle. The hammer head includes an impact head, wherein the impact head is defined by an impact face that defines an acute angle relative to the elongate handle axis of substantially 8 to 11.5 degrees to minimize strain and deflection upon an individual impacting a nail in use of the hammer. The impact face includes a semi-spherical recess to receive the nail and minimize deflection of various portions of the nail that may be factured upon impact. A modification of the invention includes deformable inserts mounted within the semi-spherical recess for minimizing abrasion to various uphostery nails and the like upon impact.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved safety hammer assembly which has all the advantages of the prior art safety hammer apparatus and none of the disadvantages.

It is another object of the present invention to provide a new and improved safety hammer assembly which may be easily and efficiently manufactured and marketed.

It is a further object of the present invention to provide a new and improved safety hammer assembly which is of a durable and reliable construction.

An even further object of the present invention is to provide a new and improved safety hammer assembly which is susceptible of a low cost of manufacture with regard to both materials and labor, and which accordingly is then susceptible of low prices of sale to the consuming public, thereby making such safety hammer assemblies economically available to the buying public.

Still yet another object of the present invention is to provide a new and improved safety hammer assembly which provides in the apparatuses and methods of the prior art some of the advantages thereof, while simultaneously overcoming some of the disadvantages normally associated therewith.

Still another object of the present invention is to provide a new and improved safety hammer assembly wherein the same provides shielding of various nail fragments effected during impact of an associated nail by the hammer.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is an orthographic side view, partially in section of the modified hammer head utilized by the instant invention.

FIG. 6 is an isometric illustration of an insert utilized by the instant invention.

FIG. 7 is an orthographic top view of further inserts utilized by the instant invention.

FIG. 8 is an orthographic cross-sectional illustration, taken along the lines 8—8 of FIG. 7 of the inserts as illustrated.

DESCRIPTION OF THE PREFERRED EMBODIMENT

Figure 1:
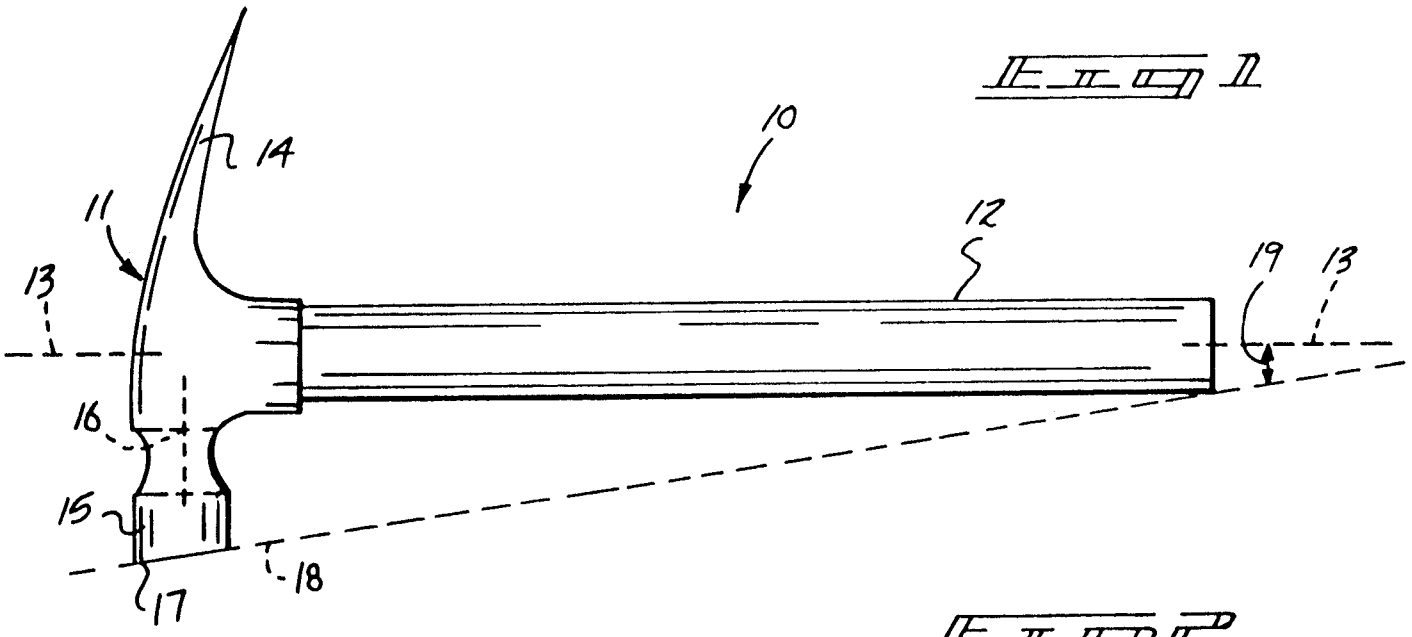
FIG. 1 is an orthographic side view of the instant invention.
Figure 2:
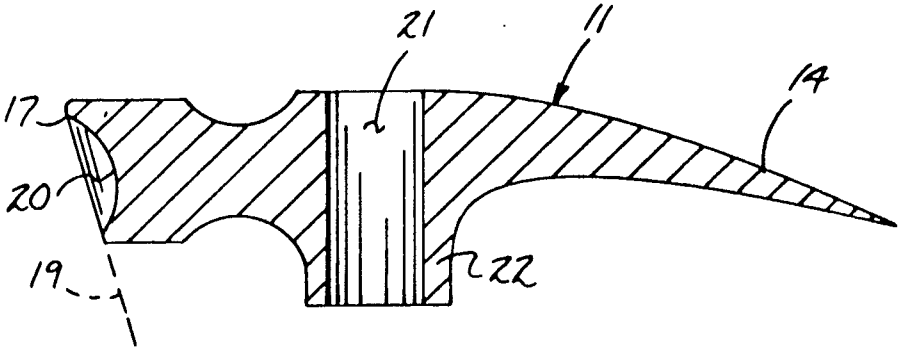
FIG. 2 is an orthographic cross-sectional illustration of the hammer head utilized by the instant invention.

With reference now to the drawings, and in particular to FIGS. 1 to 7 thereof, a new and improved safety hammer assembly embodying the principles and concepts of the present invention and generally designated by the reference numeral 10 will be described.

More specifically, the safety hammer 10 of the instant invention essentially comprises a rigid hammer head 11, including a head mounting shank 22, with a head mounting bore 21 coaxially directed therethrough, wherein the head mounting bore 21 receives an upper terminal end of an elongate handle 12. The elongate handle 12 and the head mounting bore are aligned along a handle axis 13. The hammer head 11 is defined along an impact head axis 16 that is orthogonally oriented relative to the handle axis 13, with a carpenter's claw 14 formed at a first end of the hammer head 11, and an impact head 15 formed at an opposed end of the head 11 on opposed sides of the handle axis 13. The impact head 15 includes an impact face 17, with the impact face 17 defined along an impact face plane 18 that defines an impact face angle 19 defined between the impact face plane 18 and the elongate handle axis 13, wherein the angle 19 is within a range of 8 to 11.5 degrees. This angle aligns the impact face 17 upon striking of a nail upon rotation of an individual's arm directed upon such a nail or target to minimize shock due to slippage and the like as the impact face 17 strikes.

Further, a semi-spherical recess 20 is formed within the impact face 17, with a semi-spherical recess permitting a nail therewithin. The semi-spherical recess curvature aligns the nail within the recess 20 and further provides a shrouding of a nail head to minimize deflection of various fragments that may be broken from a nail head during impact.

Figure 3:
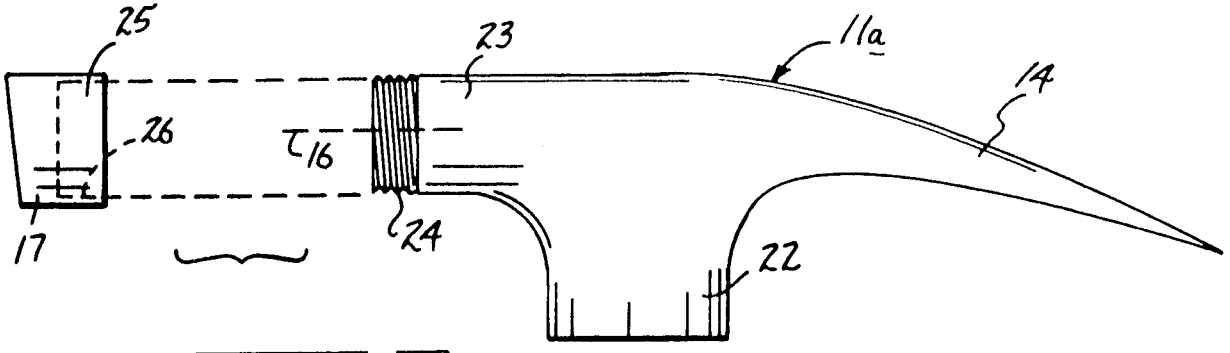
FIG. 3 is an orthographic side view of a modified hammer head utilized by the instant invention.
Figure 4:
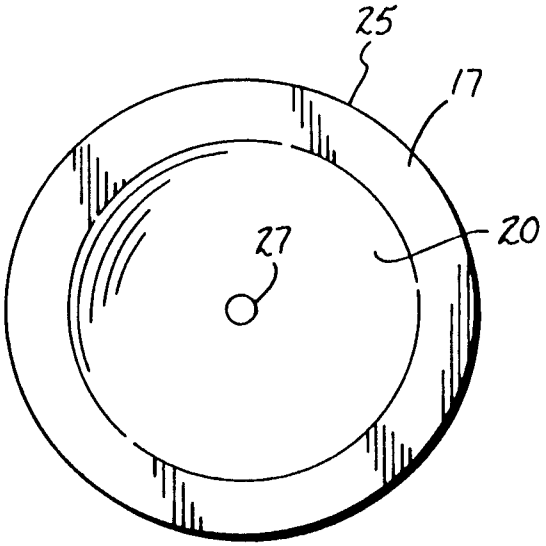
FIG. 4 is an orthographic top view of a modified impact face utilized by the head, as illustrated in FIG. 3.

FIGS. 3 and 4 illustrate the use of a modified impact head shank 23 orthogonally oriented relative to the impact head axis 16, with the shank 23 including a threaded boss 24 formed at a free terminal end thereof, with the boss 24 orthogonally oriented relative to the axis 16. The removable impact head 25 includes an internally threaded bore 26 threadedly securable to the threaded boss 24. Further, the removable impact head 25 includes a semi-spherical recess bore 27 formed medially and radially aligned relative to the threaded bore 26 to receive a deformable concave dish 30 therewithin of a deformable insert 29. The deformable insert 29 includes an insert boss 31 frictionally retained within the recess bore 27. This insert minimizes abrasion and defamation of various finishing nails and the like, such as utilized in upholstery. Further, deformable inserts *29a*, *29b*, and *29c* are provided, wherein each additionally is formed with respective first, second, and third recesses 32, 33, and 34. The first recess 32 is of a semi-spherical configuration, the second recess 33 is of a rectangular parallelepiped configuration, and the third recess 34 is of a square parallelepiped configuration to receive a respective upholstery nail 35, a concrete nail 36, and a finishing nail 37 therewithin to position the nail and secure the nail within the insert prior to impact if desired by an individual in use of the organization.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A safety hammer assembly comprising, in combination, a rigid hammer head, the rigid hammer head including a shank, the shank including a mounting bore, and an elongate handle, the elongate handle including an upper terminal end, with the upper terminal end fixedly received within the mounting bore, and the mounting bore and the handle defined along a handle axis, and the hammer head including an impact head, with the impact head aligned along an impact head axis, wherein the impact head axis is orthogonally aligned relative to the handle axis, and the impact head including an impact face, the impact face defined along an impact face plane, with the impact face plane defining an acute angle between the impact face plane and the handle axis, and the acute angle is defined within a range of 8 to 11.5 degrees, and the impact face includes a semi-spherical recess formed within the impact face, and the hammer head includes an impact head shank, the impact head shank including an externally threaded boss, and the impact head includes an internally threaded bore threadedly received within the threaded boss, and the threaded boss and the internally threaded bore are aligned orthogonally relative to the handle axis, and the semi-spherical recess includes a semi-spherical recess bore radially and medially aligned relative to the semi-spherical recess, and further including a deformable insert, the deformable insert including a concave dish receivable within the semi-spherical recess, the deformable dish including an insert boss fixedly mounted to a rear surface of the dish, and the insert boss frictionally retained within the semi-spherical recess bore.

2. An apparatus as set forth in claim 1 wherein the concave dish includes a further recess aligned with the insert boss formed within a forward face of the dish opposed to the insert boss, wherein the further recess is arranged for frictionally retaining a nail head therewithin.

* * * * *